US007918528B2

(12) United States Patent
Govyadinov et al.

(10) Patent No.: US 7,918,528 B2
(45) Date of Patent: Apr. 5, 2011

(54) DROP DETECTOR SYSTEM AND METHOD WITH LIGHT COLLECTOR

(75) Inventors: Alexander Govyadinov, Corvallis, OR (US); Robert Newton Bicknell, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 170 days.

(21) Appl. No.: 12/254,864

(22) Filed: Oct. 21, 2008

(65) Prior Publication Data

US 2009/0273620 A1 Nov. 5, 2009

Related U.S. Application Data

(60) Provisional application No. 61/050,475, filed on May 5, 2008.

(51) Int. Cl.
*B41J 2/01* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 5,304,814 | A * | 4/1994 | Markham | 250/573 |
| 5,589,858 | A | 12/1996 | Kadowaki et al. | |
| 5,621,524 | A | 4/1997 | Mitani | |
| 5,742,303 | A | 4/1998 | Taylor et al. | |
| 5,774,141 | A | 6/1998 | Cooper et al. | |
| 5,896,145 | A | 4/1999 | Osborne et al. | |
| 6,088,134 | A | 7/2000 | Schmidt | |
| 6,168,258 | B1 | 1/2001 | Lou et al. | |
| 6,299,275 | B1 | 10/2001 | Elgee | |
| 6,513,900 | B2 * | 2/2003 | Endo et al. | 347/19 |
| 6,585,349 | B1 | 7/2003 | Lou et al. | |
| 6,648,444 | B2 | 11/2003 | Valero et al. | |
| 6,747,684 | B2 | 6/2004 | Ornellas et al. | |
| 6,767,122 | B2 | 7/2004 | Honguh et al. | |
| 6,786,626 | B2 | 9/2004 | Wu et al. | |
| 6,802,580 | B2 | 10/2004 | Valero | |
| 6,851,816 | B2 | 2/2005 | Wu et al. | |
| 6,877,838 | B2 | 4/2005 | Elgee | |
| 6,966,664 | B2 | 11/2005 | Wu | |
| 6,984,013 | B2 | 1/2006 | Arqullevich et al. | |
| 7,055,925 | B2 | 6/2006 | Subirada et al. | |
| 7,125,151 | B2 | 10/2006 | Uemura et al. | |
| 7,140,762 | B2 | 11/2006 | Wu et al. | |
| 7,249,830 | B2 | 7/2007 | Hawkins et al. | |
| 7,267,467 | B2 | 9/2007 | Wu et al. | |

(Continued)

FOREIGN PATENT DOCUMENTS

| | | |
|---|---|---|
| JP | 2001113725 | 4/2001 |

(Continued)

OTHER PUBLICATIONS

Machine-generated translation of JP 2001-113725, published on Apr. 2001.*

(Continued)

*Primary Examiner* — Huan H Tran

(57) ABSTRACT

One aspect is a drop detection arrangement including a light source for projecting a light beam for scattering light off of an ejected drop. The arrangement includes a light collector configured to collect the scattered light off the ejected drop and a light detector coupled to the light collector and configured to process scattered light into an output signal. The arrangement includes a controller configured to receive the output signal from the light detector. The output signal is indicative of the condition of the ejected drop.

19 Claims, 7 Drawing Sheets

U.S. PATENT DOCUMENTS

| | | | | |
|---|---|---|---|---|
| 7,287,833 | B2 | 10/2007 | Howard | |
| 7,364,276 | B2 | 4/2008 | Piatt et al. | |
| 7,442,180 | B2 | 10/2008 | Vitello et al. | |
| 7,452,053 | B2 | 11/2008 | Valles et al. | |
| 7,490,918 | B2 * | 2/2009 | Nagashima | 347/19 |
| 2001/0019480 | A1 | 9/2001 | Fujino et al. | |
| 2005/0024410 | A1 | 2/2005 | Subirada et al. | |
| 2006/0120098 | A1 | 6/2006 | Ikeda et al. | |
| 2006/0139392 | A1 | 6/2006 | Fernandez et al. | |
| 2006/0187651 | A1 | 8/2006 | Kim et al. | |
| 2006/0279601 | A1 * | 12/2006 | Unosawa et al. | 347/19 |
| 2007/0024658 | A1 * | 2/2007 | Diol et al. | 347/19 |
| 2007/0064068 | A1 | 3/2007 | Piatt et al. | |
| 2008/0180471 | A1 | 7/2008 | Han | |
| 2008/0246803 | A1 | 10/2008 | Barger et al. | |
| 2009/0091595 | A1 * | 4/2009 | Hayashi et al. | 347/19 |
| 2009/0141057 | A1 | 6/2009 | Hayashi et al. | |
| 2009/0179934 | A1 | 7/2009 | Takagi et al. | |

FOREIGN PATENT DOCUMENTS

| | | | |
|---|---|---|---|
| JP | 2005083769 | | 3/2005 |
| JP | 2006-047235 | * | 2/2006 |
| JP | 2006-346906 | * | 12/2006 |
| JP | 2007-119971 | * | 5/2007 |
| WO | WO 2007/015808 | | 2/2007 |
| WO | 2009120436 | | 10/2009 |

OTHER PUBLICATIONS

Printability and Ink-Coating Interactions in Inkjet Printing by Erik Svanholm Feb. 2007.

Written Opinion of the International Search Authority for International Application No. PCT/US2009/034892 mailed Jul. 28, 2009 (5 pages).

International Search Report for International Application No. PCT/US2009/034892 mailed Jul. 28, 2009 (3 pages).

* cited by examiner

DROP DETECTOR SYSTEM AND METHOD WITH LIGHT COLLECTOR

CROSS REFERENCE TO RELATED APPLICATIONS

This Application claims the benefit of provisional patent application Ser. No. 61/050,475, filed May 5, 2008 titled "DROP DETECTOR SYSTEM AND METHOD WITH LIGHT COLLECTOR" which application is incorporated by reference herein as if reproduced in full below.

BACKGROUND

In some applications, drop detection devices are utilized to detect ink drops ejected by printhead nozzles. Based on the detection of ink drops, the status of a particular nozzle or groups of nozzles can be diagnosed. For example, nozzles through which ink drops are ejected may become clogged or otherwise cease to operate properly. The ink drop detectors can be used to determine whether a printhead actually requires cleaning or other maintenance.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Figure 1:
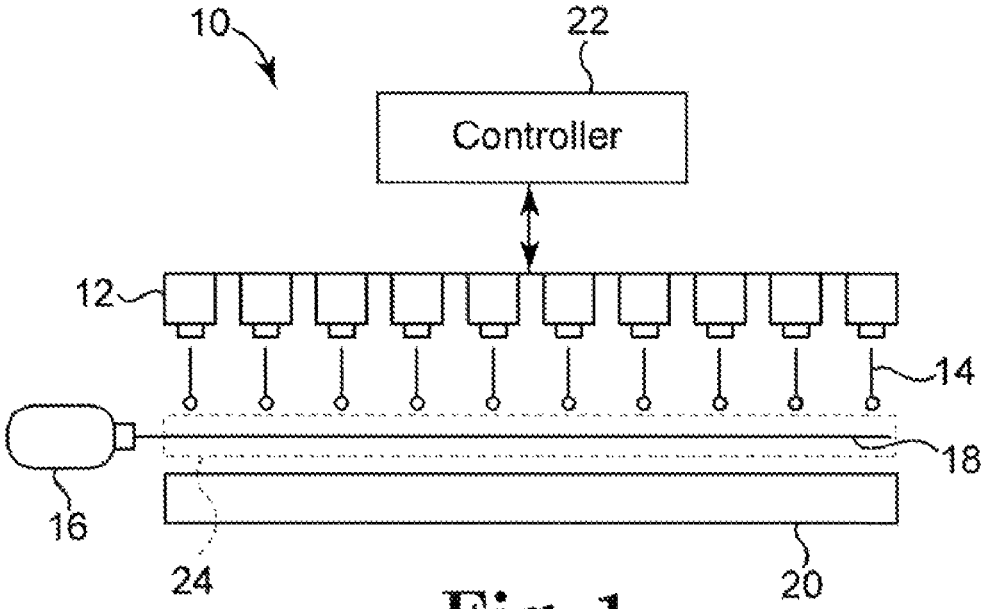
FIG. 1 is a drop detector arrangement in accordance with one embodiment.

FIG. 1 illustrates a drop detector arrangement 10 in accordance with one embodiment. In one embodiment, drop detector arrangement 10 includes a plurality of drop ejectors 12, each configured to dispense an ink droplet 14. Arrangement 10 further includes a light source 16, which emits a light beam 18. Arrangement 10 also includes service station 20, controller 22, and light collector 24. In operation of one embodiment, drop detector arrangement 10 is configured for use in a variety of applications where the controlled ejection of ink droplets is to be monitored. For example, where ink drops are to be deposited on print media in a print engine for an inkjet printer, such a drop detector arrangement 10 may be used to monitor the ejection of ink.

In one embodiment, controller 22 is configured to control the plurality of drop ejectors 12 such that ink droplets 14 are controllably ejected to service station 20. In one embodiment, print media is received adjacent service station 20 such that ink droplets 14 are controllably deposited on the print media.

In one embodiment, light source 16 is configured to project light beam 18 between the plurality of drop ejectors 12 and service station 20. As such, when ink droplets 14 are ejected drop ejectors 12, ink droplets 14 pass through light beam 18 as they drop to service station 20. As an ink droplet 14 passes through light beam 18, light from light beam 18 is scattered in various directions. Light collector 24 is illustrated adjacent light beam 18 and some of the scattered light will enter light collector 24. Light collect 24 is illustrated in dotted lines in FIG. 1, because it is "behind" light beam 18 in the particular orientation in the figure.

In one embodiment, light collected into light collector 24 from the light scattering that occurred when ink droplet 14 passed through light beam 18 can be used to measure the effectiveness or status of ink droplet 14 from one or more of ejectors 12. For example, if controller 22 directs one particular drop ejector to eject and ink droplet 14 at a particular point in time, corresponding light scattering from ink droplet 14 passing through light beam 18 should enter light collector 24. By monitoring the collected light and correlating it with control signals from controller 24, a determination can be made as to whether an ink droplet 14 did in fact eject, as well as determinations about the size and quality of ink droplet 14.

Figure 2:
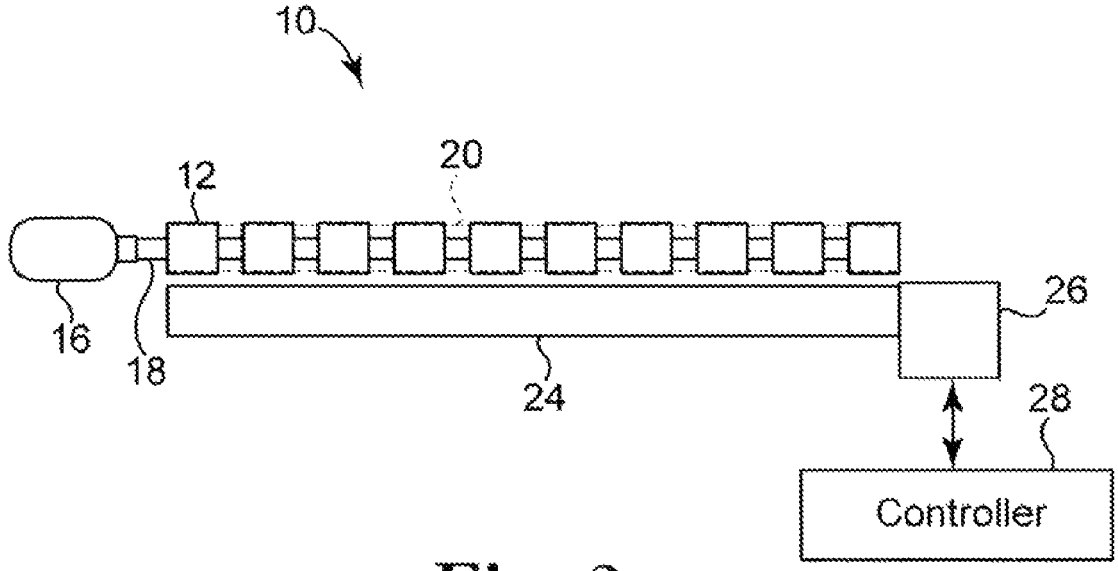
FIG. 2 is a drop detector arrangement in accordance with one embodiment.

FIG. 2 illustrates drop detector arrangement 10 in accordance with one embodiment. Drop detector arrangement 10 illustrated in FIG. 2 is rotated 90 degrees relative to the orientation of drop detector arrangement 10 illustrated in FIG. 1. For example, if drop detector arrangement 10 in FIG. 1 is considered to be a "side" view, FIG. 2 is then considered a "top" view. Light collector 24 is visible in FIG. 2 immediately adjacent the plurality of drop ejectors 12 and adjacent light beam 18. Service station 20 is illustrated "under" the plurality of drop ejectors 12 and is therefore illustrated in dotted lines.

In one embodiment, light collector 24 includes light detector 26. In one embodiment, a first end of light collector 24 is located adjacent light source 16 and light detector 26 is located at a second end of light collector 24, which is opposite the first end. In one example, light detector 26 is coupled to controller 28, which is configured to process light signals that are collected in light collector 24 and then coupled into light detector 26. In one example, controller 28 may be separate from controller 22, while in other examples, controllers 22 and 28 can be the same controller.

In one embodiment, light source 16 is a collimated light source such as a laser diode device or similar device. In various embodiments, the shape of light beam 18 is circular, elliptical, rectangular or other shape. As ink droplets 14 pass through light beam 18, light is scattered in various directions.

Figure 3:
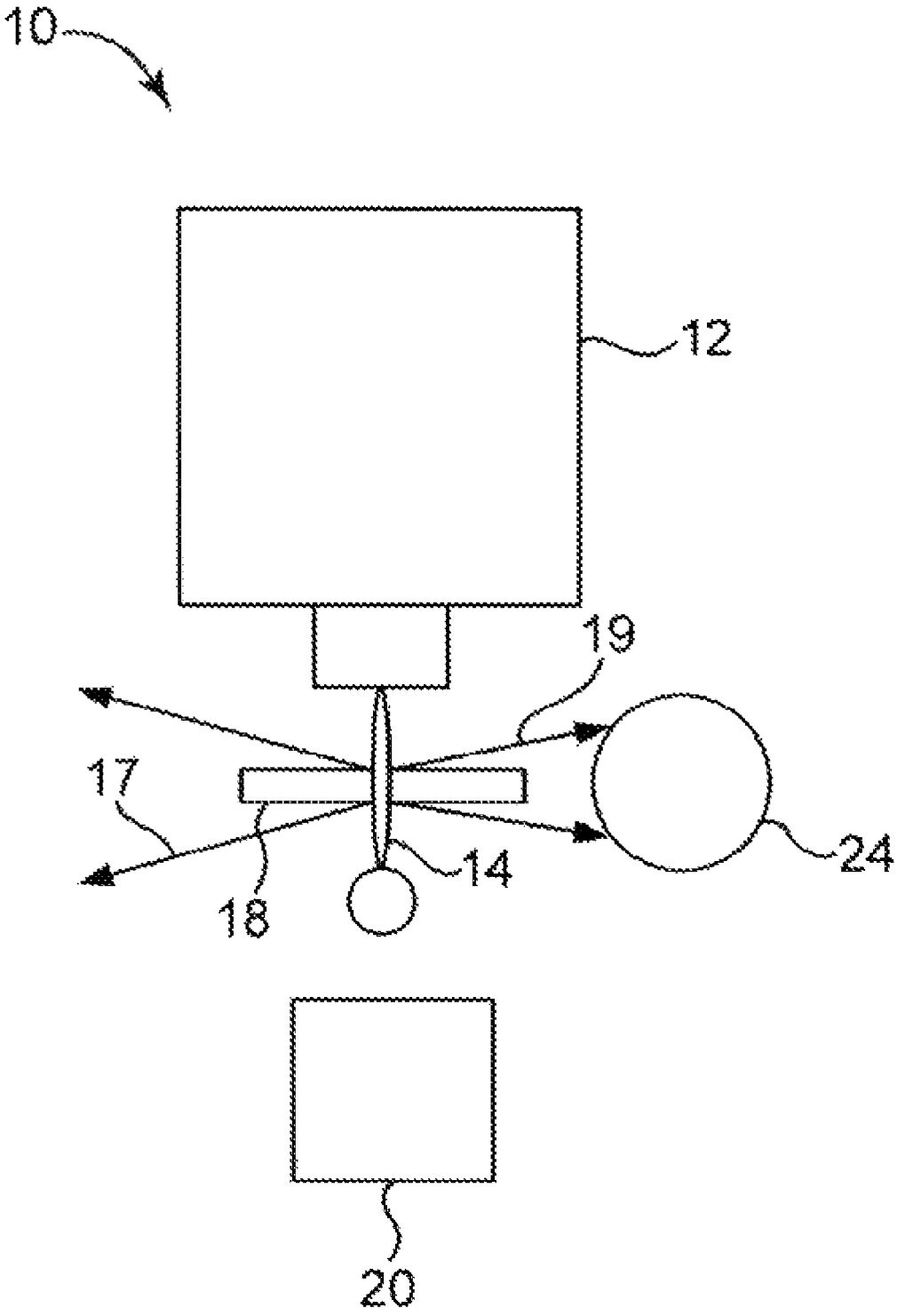
FIG. 3 illustrates a cross-sectional view of a drop detector arrangement in accordance with one embodiment.

FIG. 3 illustrates a cross-sectional view of drop detector arrangement 10 in accordance with one embodiment. In FIG. 3, a drop ejector 12 is illustrated above service station 20. A light beam 18 is illustrated between drop ejector 12 and service station 20 and an ink droplet 14 is illustrated passing through light beam 18. Light collector 24 is illustrated adjacent light beam 18 and positioned vertically in the figure between drop ejector 12 and service station 20.

As illustrated in the embodiment, as ink droplet 14 passes through light beam 18, scattered light 17 and 19 is deflected in various orientations. Light will scatter in many directions, but for ease of illustration just a few examples are shown. Some scattered light 17 is directed away from light collector 24, while some scattered light 19 is directed into light collector 24. In one embodiment, light collector 24 is configured to collect scattered light 19 and to direct it to light detector 26 for further processing.

In one embodiment, light collector 24 is a tubular-shaped light pipe that is configured to be adjacent each of a series of drop ejector nozzles 12. As such, as each nozzle 12 ejects an ink droplet 14 through light beam 18, scattered light 19 is collected all along the length of light collector 24. In this way, only a single collector 24 is needed to collect scattered light 19 from a plurality of drop ejectors 12 located along its length. Collector 24 then propagates all of this collected scattered light 19 from the various ink droplets 14 to light detector 26 for further processing.

Figure 4:
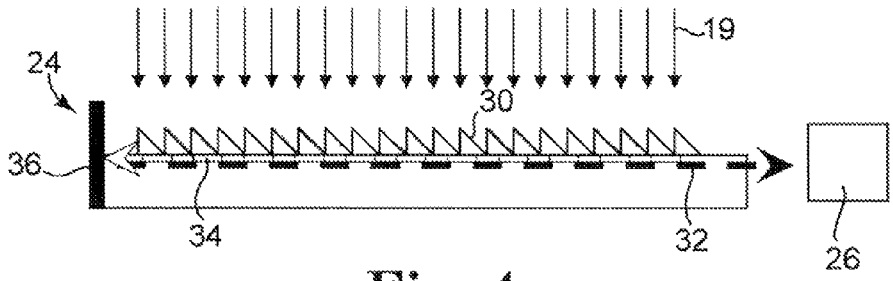
FIG. 4 illustrates a portion of a drop detector arrangement, including a light collector, in accordance with one embodiment.

FIG. 4 illustrates a portion of a drop detector arrangement 10 in accordance with one embodiment, including light collector 24 and light detector 26. In one embodiment, scattered light 19 is collected into light collector 24. In one instance, scattered light 19 is scattered as an ink droplet 14 passes through light beam 18, and in other instances, it is scattered from a plurality of ink droplets 14 passing through light beam 18. In one embodiment, each of the arrows 19 illustrate light scatted from an ink droplet 14 passing through light beam 18. Although it is likely that in practice ink droplets 14 would be ejected at different points in time, all of the scattered light 19 is illustrated in the figure for ease of illustration.

In one embodiment, light collector 24 is configured with grating 30. In one example, grating 30 has a pitch that is angle to deflect most of scattered light 19 toward light detector 26 in the direction of darkened and dashed arrow 32. In one embodiment, regardless of where scattered light 19 enters light collector 24 along its length, much of the light will be propagated in the direction of arrow 32.

Scattered light 19 that is not deflected in the direction of arrow 32 by grating 30 will generally move in the direction of dashed arrow 34. In one embodiment, light collector 24 is configured with mirror 36 at an end opposite light detector 26. In this way, light scattered in the direction of arrow 34 will be reflected off mirror 36 and back toward light detector 26 in the direction of arrow 34.

In one embodiment, light detector 26 includes a photodetector, or similar sensor of light or other electromagnetic energy capable of detecting scattered light 19 from droplet 14 passing through light beam 18. In one embodiment, light detector 26 includes a charge-coupled device (CCD) array having a plurality of cells that provide sensing functions. The CCD array by means of the plurality of cells detects the light in its various intensities. In one embodiment, light detector 26 receives scattered light 19 and generates an electrical signal that is representative of the scattered light 19.

Figure 5:
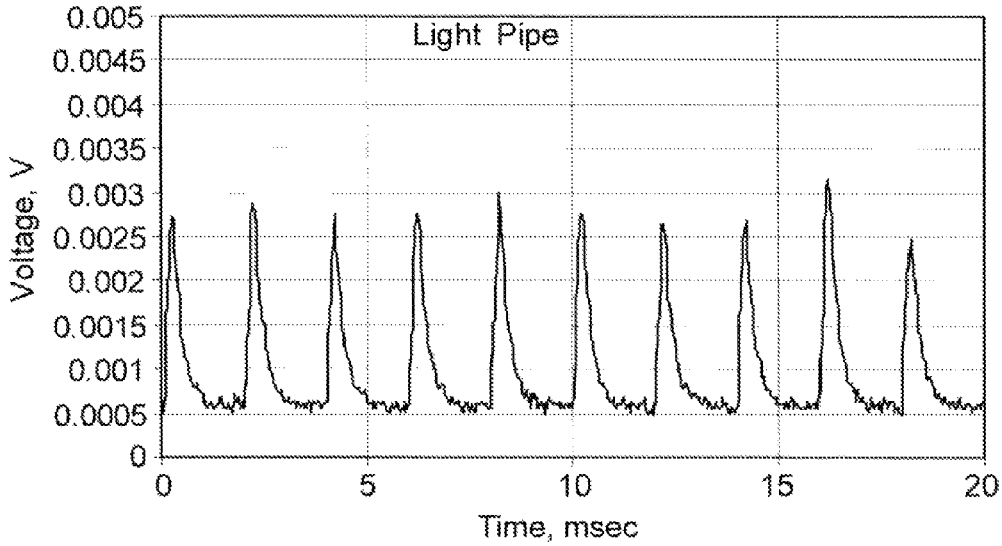
FIG. 5 illustrates a signal representative of light collected in a light collector in a drop detector arrangement in accordance with one embodiment.

FIG. 5 illustrates an output signal representative of scattered light 19 collected in light collector 24 over a period of time and then received and processed by light detector 26. The example describes drop detection of nozzle firing with 500 Hz frequency. Every peak corresponds individual droplets, ejected from drop ejector-nozzle. In the illustration, the signal has a plurality of voltage peaks over time, that is, just before 1 millisecond, just after 2 milliseconds at approximately 4 milliseconds, and so on. Each of the these peaks represent a peak amount of scattered light 19 collected in light collector 24 due to an ink droplet having passed through light beam 18. In one embodiment, the output signal is received by controller 28.

In one example, controller 22 controls the plurality of drop ejectors 12 such that each is configured to dispense an ink droplet 14 at a specified time. As such, each corresponding ink droplet 14 passes though light beam 18 at a known time the corresponding scattered light 19 collected produces a peak in the output signal that can be correlated by controller 28 in order to verify an ink droplet 14 was indeed produced, and also to verify the quality of ink droplet 14.

For example, controller 28 can analyze the peaks of the output signal to evaluate whether there was an ink droplet 14 or not (detected by the presence of a peak versus the absence of a peak), evaluate ink droplet 14 velocity, or the time that it takes ink droplet 14 to cross light beam 18 (measured by the width of one of the peaks of the output signal), and evaluate ink droplet 14 volume (measured by the cross-section of one of the peaks of the output signal.

Each of these parameters can be useful in certain ink drop arrangements or printers to give an indication of how the system is performing, and also in performing maintenance on the system. For instance, the absence of an ink drop 14 can indicate that a nozzle 12 failed to fire or is misfiring. The presence an ink drop 14 can indicate that the nozzle 12 is firing. The size of the ink drop 14 provides further information pertaining to the working status of the nozzle 12. An ink drop 14 that is smaller than usual indicates that a particular nozzle 12 may be partially clogged or misfiring.

Figure 9A:
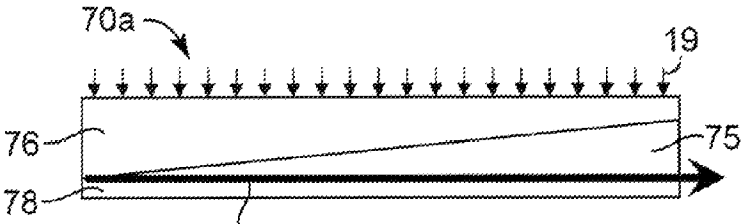
FIGS. 9A-9C illustrate light collectors in drop detection arrangements in accordance with various embodiments.
Figure 9B:
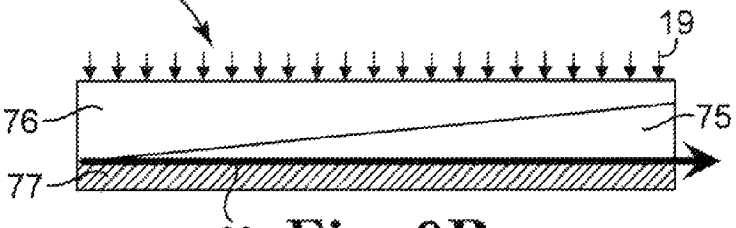
Figure 9C:
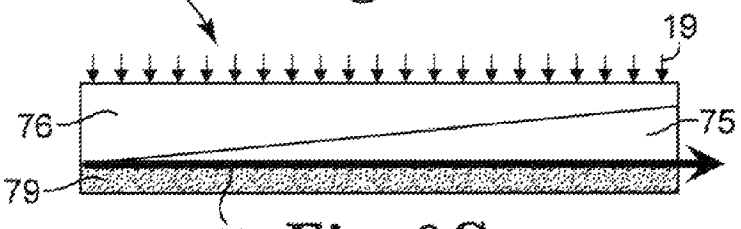
Figure 10:
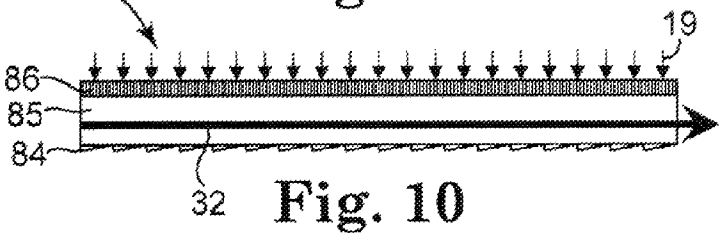
FIG. 10 illustrates a light collector in a drop detection arrangement in accordance with one embodiment.
Figures 11A, 11B, 11C, 11D, 11E, 11F, 11G:
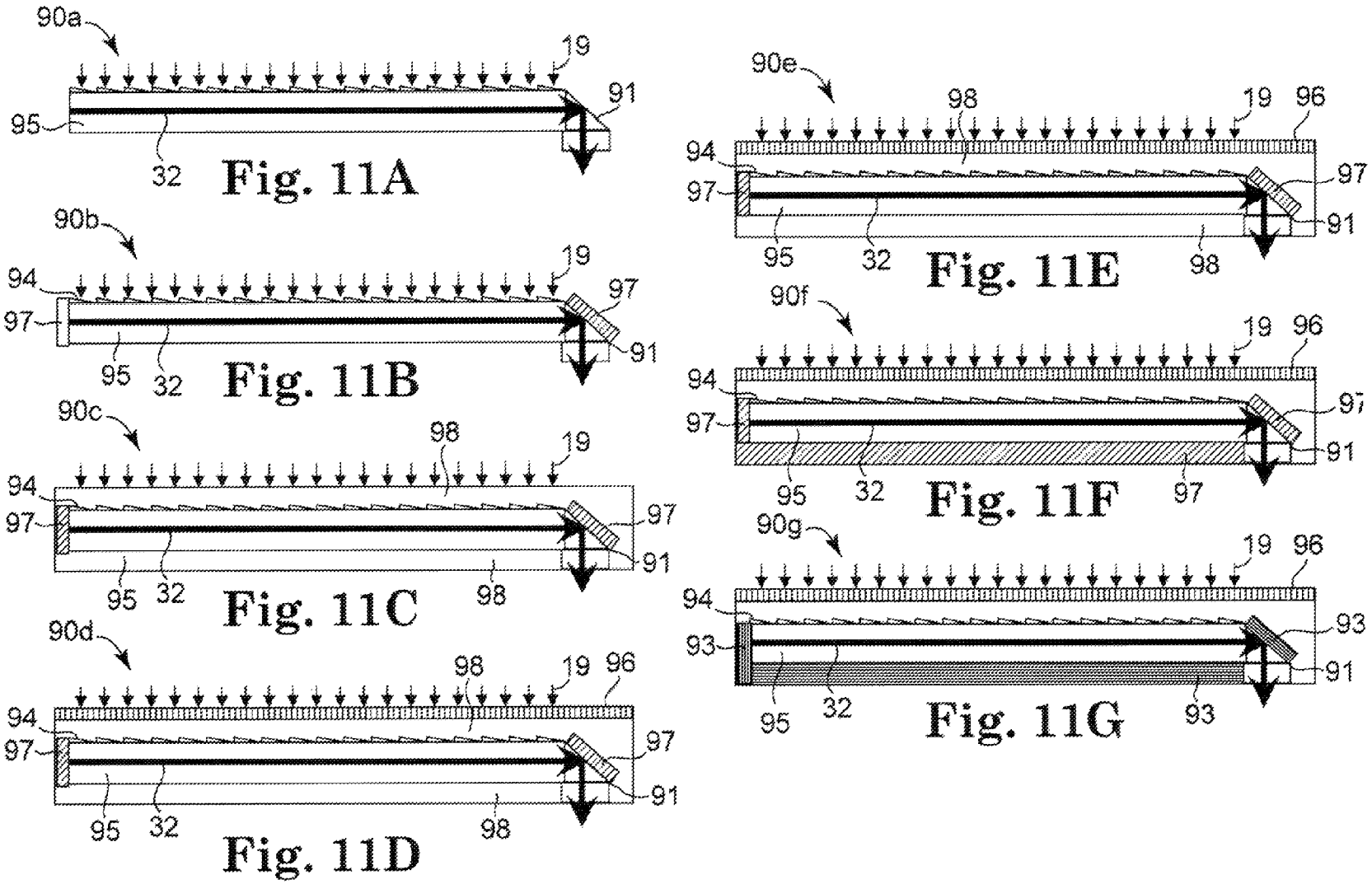
FIGS. 11A-11G illustrate light collectors in drop detection arrangements in accordance with various embodiments.
Figure 12A:
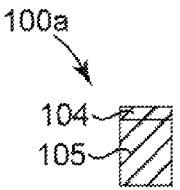
FIGS. 12A-12D illustrate cross-sectional views of light collectors in accordance with various embodiments.
Figure 12B:
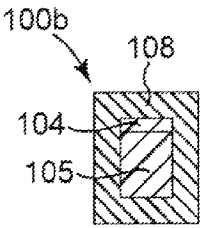
Figure 12C:
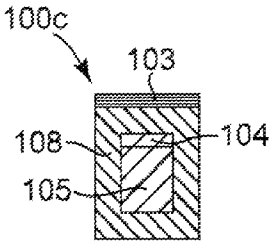
Figure 12D:
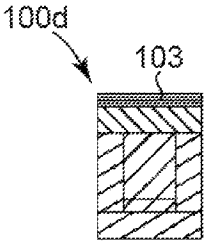
Figure 13A:
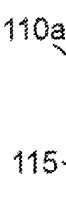
FIGS. 13A-13D illustrate cross-sectional views of light collectors in accordance with various embodiments.
Figure 13B:
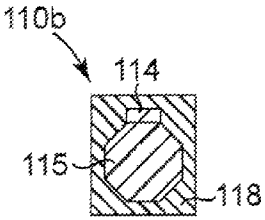
Figure 13C:
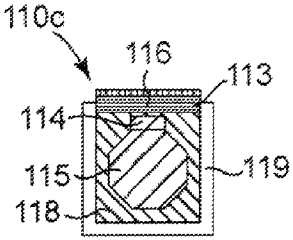
Figure 13D:
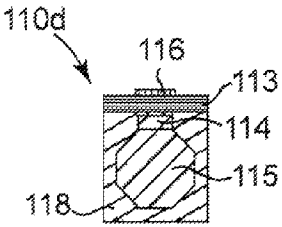
Figure 14A:
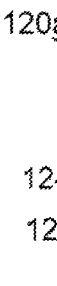
FIGS. 14A-14D illustrate cross-sectional views of light collectors in accordance with various embodiments.
Figure 14B:
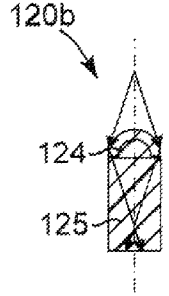
Figure 14C:
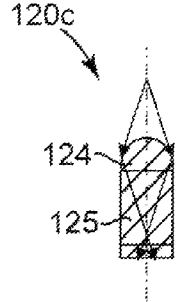
Figure 14D:
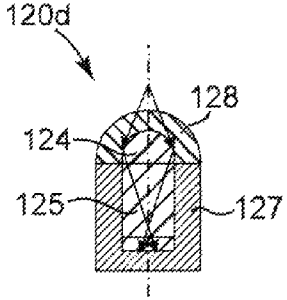

Although FIG. 4 illustrates one example of a light collector 24 configured for gathering scattered light 19, various other configurations are also possible and are illustrated in FIGS. 6-14. For example, FIGS. 6A-6C each respectively illustrates light collectors 40*a*, 40*b*, and 40*c*; FIGS. 7A-7C each respectively illustrates light collectors 50*a*, 50*b*, and 50*c*; FIGS. 8A-8C each respectively illustrates light collectors 60*a*, 60*b*, and 60*c*; FIGS. 9A-9C each respectively illustrates light collectors 70*a*, 70*b*, and 70*c*; FIG. 10 illustrates light collector 80; FIGS. 11A-11G each respectively illustrates light collectors 90*a*, 90*b*, 90*c*, 90*d*, 90*e*, 90*f* and 90*g*; FIGS. 12A-12D each respectively illustrates light collectors 100*a*, 100*b*, 100*c* and 100*d*; FIGS. 13A-13D each respectively illustrates light collectors 110*a*, 110*b*, 110*c* and 110*d*; and FIGS. 14A-14D illustrate each respectively illustrates light collectors 120*a*, 120*b*, 120*c* and 120*d*, all in accordance with various embodiments. Any of these light collector configurations can be inserted into the systems illustrated in FIGS. 1-4 for light collector 24.

Figure 6A:
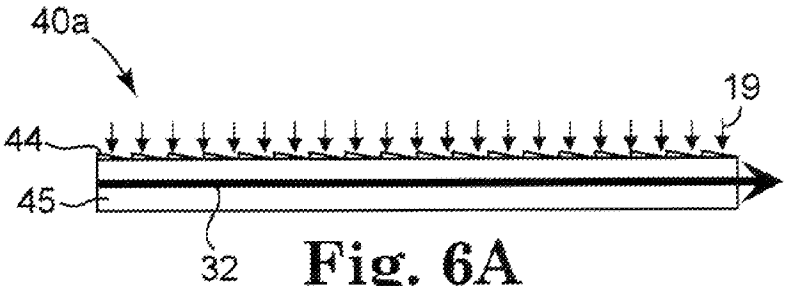
FIGS. 6A-6C illustrate light collectors in drop detection arrangements in accordance with various embodiments.

FIG. 6A illustrates light collector 40*a*, which is similar to that illustrated in FIG. 4. Light collector 40*a* includes grating 44 configured to reflect incoming scattered light 19 primarily in direction 32 toward a light detector (not illustrated in FIG.

6A). In one embodiment, light collector 40*a* includes core 45 adjacent grating 44 to facilitate the transmission of light to a light detector.

Figure 6B:
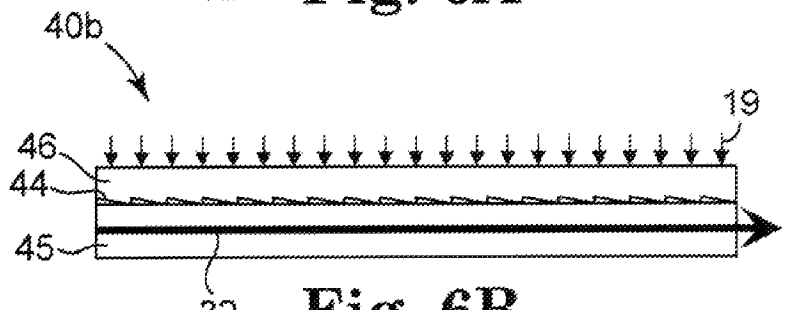

FIG. 6*b* illustrates light collector 40*b*, which is similarly provided with grating 44 and core 45 and configured to reflect incoming scattered light 19 primarily in direction 32. In addition, collector 40*b* also includes first cladding layer 46 adjacent grating 44. As such, scattered light 19 first passed through cladding 46 before engaging grating 44 and propagating down core 45. In one embodiment, first cladding layer 46 provides a protective layer over core 45 to prevent it from scratching and other defects.

Figure 6C:
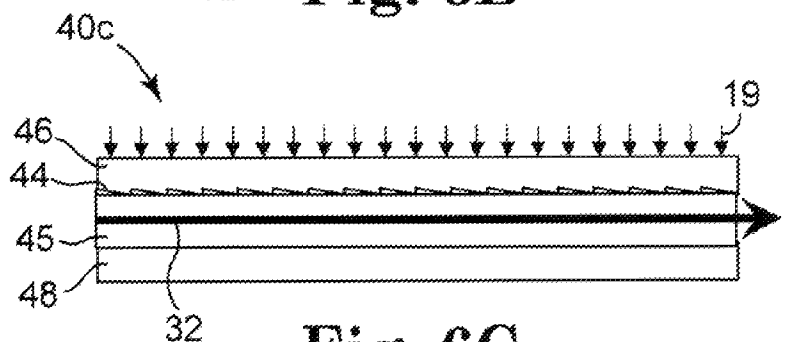

FIG. 6*c* illustrates light collector 40*c*, which is similarly provided with grating 44, core 45 and first cladding layer 46 and configured to reflect incoming scattered light 19 primarily in direction 32. In addition, collector 40*c* also includes second cladding layer 48 adjacent core 45, such that core 45 is sandwiched between first and second cladding layers 46 and 48. In one embodiment, the refractive index of the claddings 46 and 48 and of the core 45 can be selected so that total internal reflection is achieved. In this way, the maximum amount of light collected into light collector 40*c* is transmitted to a light detector. In one example, the refractive index of each of the claddings 46 and 48 is less that of the core 45 enabling total internal reflection. In another example, the refractive index of the claddings 46 and 48 is n=1.5, and the refractive index of the core 45 is n=2.2.

Figure 7A:
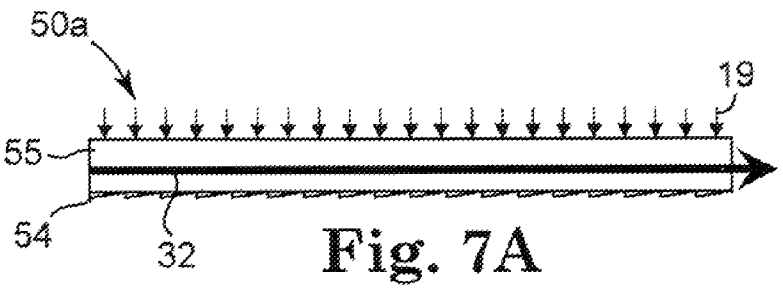
FIGS. 7A-7C illustrate light collectors in drop detection arrangements in accordance with various embodiments.

FIG. 7A illustrates light collector 50*a*. Light collector 50*a* includes grating 54 configured to reflect incoming scattered light 19 primarily in direction 32, for example toward a light detector (not illustrated in FIG. 7A). In one embodiment, light collector 50*a* includes core 55 adjacent grating 54 to facilitate the transmission of light to the light detector. In one embodiment grating 54 is located adjacent a side of core 55 opposite that into which scattered light 19 enters (rather than the same side as in FIG. 6A).

Figure 7B:
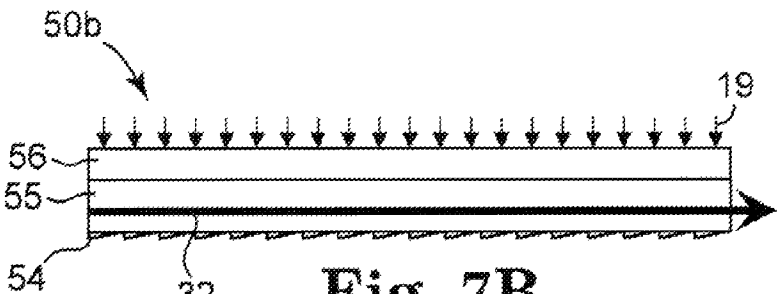

FIG. 7B illustrates light collector 50*b*, which is similarly provided with grating 54 and core 55 and configured to reflect incoming scattered light 19 primarily in direction 32. In addition, collector 50*b* also includes first cladding layer 56 adjacent grating 54. As such, scattered light 19 first passed through cladding 56 before engaging grating 54 and propagating down core 55. In one embodiment, first cladding layer 56 provides a protective layer over core 55 to prevent it from scratching and other defects. Additionally, the coating may be used as AR (antireflective coating) to increase light collector efficiency, which minimizes reflective losses from the surface of the light collector.

Figure 7C:
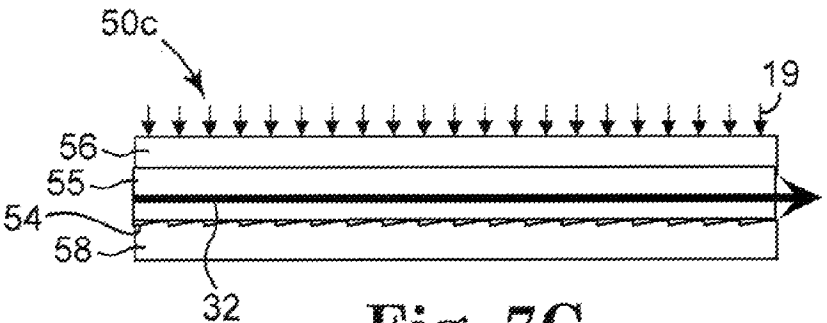

FIG. 7C illustrates light collector 50*c*, which is similarly provided with grating 54, core 55 and first cladding layer 56 and configured to reflect incoming scattered light 19 primarily in direction 32. In addition, collector 50*c* also includes second cladding layer 58 adjacent core 55, such that core 55 is sandwiched between first and second cladding layers 56 and 58. In one embodiment, the refractive index of the claddings 56 and 58 and of the core 55 can be selected so that total internal reflection is achieved. In this way, the maximum amount of light collected into light collector 50*c* is transmitted to a light detector. In one example, the refractive index of each of the claddings 56 and 58 is half that of the core 55. In another example, the refractive index of the claddings 56 and 58 is n=1.5, and the refractive index of the core 55 is n=2.2.

Figure 8A:
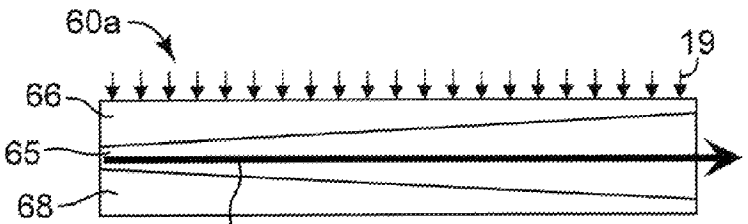
FIGS. 8A-8C illustrate light collectors in drop detection arrangements in accordance with various embodiments.

FIG. 8A illustrates light collector 60*a*, including tapered core 65 and first and second tapered cladding layers 66 and 68, which are configured to reflect incoming scattered light 19 primarily in direction 32, for example toward a light detector (not illustrated in FIG. 8A). In one embodiment, core 65, first cladding 66 and second cladding 68 are tapered to have sloped surfaces that help propagate light within core 65 to a light detector. As with previously-described embodiments, the relative indices of refractive of the claddings 66 and 68 and of the core 65 can be selected so that total internal reflection is achieved.

Figure 8B:
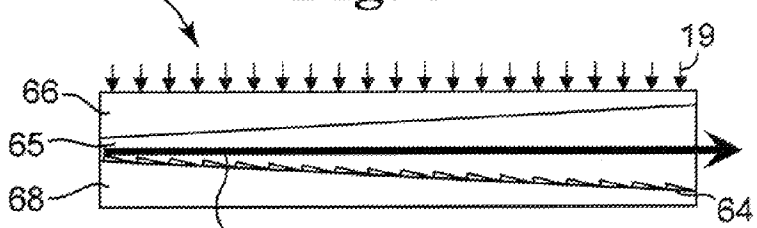
Figure 8C:
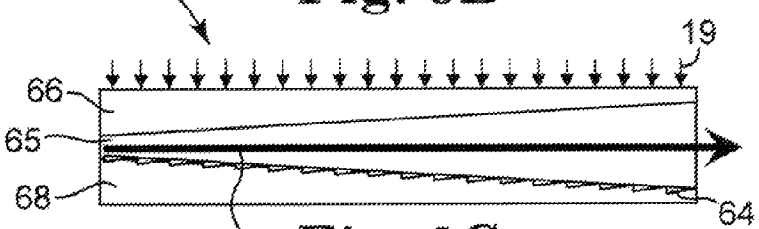

FIGS. 8B and 8C similarly illustrate light collectors 60*b* and 60*c*, respectively, including tapered core 65 and first and second tapered cladding layers 66 and 68, which are configured to reflect incoming scattered light 19 primarily in direction 32. Each also includes grating 64 to help facilitate the direction of scattered light 19 in the direction 32. In FIG. 8B grating 64 is illustrated on an upper portion of the lower surface of core 65, while in FIG. 8C grating 64 is located under the lower surface of core 65.

FIG. 9A illustrates light collector 70*a*, including tapered core 75, first tapered cladding layer 76, and second cladding layer 78, which are configured to reflect incoming scattered light 19 primarily in direction 32, for example toward a light detector (not illustrated in FIG. 9A). In one embodiment, core 75 and first cladding layer 76 are tapered to have sloped surfaces that help propagate light within core 75 to a light detector. In one embodiment, the surface between tapered core 75 and first tapered cladding layer 76 can be slightly graded or stepped to aid in propagating light in the direction of arrow 32. As with previously-described embodiments, the relative indices of refractive of the claddings 76 and 78 and of the core 75 can be selected so that total internal reflection is achieved.

FIG. 9B similarly illustrates light collector 70*b*, including tapered core 75 and first tapered cladding layer 76, and mirror layer 77, which are configured to reflect incoming scattered light 19 primarily in direction 32. FIG. 9C similarly illustrates light collector 70*b*, including tapered core 75 and first tapered cladding layer 76, and white Lambertian layer 79, which are configured to reflect incoming scattered light 19 primarily in direction 32. In some embodiments, mirror layer 77 and white Lambertian layer 79 each aid in propagating light 19 in collector 70*b*.

FIG. 10 illustrates light collector 80, including grating 84 and core 85 and is configured to reflect incoming scattered light 19 primarily in direction 32 toward a light detector (not illustrated in FIG. 10). In one embodiment, light collector 80 includes antireflective coating 86 over core 85 to minimize reflection and maximize the amount of scattered light 19 that is coupled into light collector 80.

FIGS. 11A-11G illustrate light collector 90*a*-90*g*, variously including diverting elbow 91, reflective coating 93, grating or steps 94, core 95, antireflective coating 96, mirrored portion 97, cladding layers 98, and Lambertian layer 99. These various embodiments can be used in applications where there are space restraints, and diverting elbow 91 can be used to redirect light to a light detector, which can then be placed in a variety of locations relative to the light collectors 90*a*-90*g*. One or multiple diverting elbows 91 can be used.

Light collector 24 can have a generally tubular or pipe-like shape, but various other embodiments include a variety of other cross-sectional shapes. For example, FIGS. 12A-12D illustrate light collectors 100*a*-100*d* having substantially rectangular cross-sections. In embodiments, light collectors 100*a*-100*d* include reflective coating 103, grating or steps 104, core 105, mirrored portion 107, and cladding layers 108.

FIGS. 13A-13D illustrate light collectors 110*a*-110*d* having substantially octagonal cross-sections. In embodiments, light collectors 110*a*-110*d* include reflective coating 113, grating or steps 114, core 115, antireflective coating 116, mirrored portion 117, cladding layers 118 and Lambertian layer 119.

FIGS. 14A-14D illustrate light collectors 120*a*-120*d* having various other shaped cross-sections. In embodiments, light collectors 110*a*-110*d* include grating or steps 124, core 125, mirrored portion 127, and cladding layers 128. Any of a variety of these embodiments and configurations can be used in various applications to optimize the light coupled into light collector 24.

Finally, although several combinations of layers and configurations have been illustrated for light collectors, one skilled in the art will understand that many various combinations and portions of each of these embodiments can be used to achieve various other embodiments.

Although specific embodiments have been illustrated and described herein, it will be appreciated by those of ordinary skill in the art that a variety of alternate and/or equivalent implementations may be substituted for the specific embodiments shown and described without departing from the scope of the present invention. For example, the drop detector arrangement 10 could be used in conjunction with a computer printer, or with any of a variety of drop ejection systems while remaining within the spirit and scope of the present invention. This application is intended to cover any adaptations or variations of the specific embodiments discussed herein. Therefore, it is intended that this invention be limited only by the claims and the equivalents thereof.

What is claimed:

1. A drop detection arrangement comprising:

a light source for projecting a light beam for scattering light off of an ejected drop;

a light collector configured to collect the scattered light off the ejected drop;

a light detector coupled to the light collector and configured to process scattered light into an output signal comprising a series of peaks, each peak indicative of an ejected drop passing through the light beam; and a controller configured to receive the output signal from the light detector, the output signal indicative of the condition of the ejected drop.

2. The drop detection arrangement of claim 1 further comprising a plurality of ink drop ejectors, wherein the light collector is configured adjacent the plurality of ink drop ejectors such that each ink drop ejected from the plurality of ink drop ejectors passes through the light beam thereby scattering light into the light collector.

3. The drop detection arrangement of claim 2, wherein the controller is configured to control the plurality of ink drop ejectors and to correlate control of the plurality ink drop ejectors with the output signal such that the condition of each of the ejected drops can be correlated to a particular ink drop ejector.

4. The drop detection arrangement of claim 1, wherein the light source comprises one of a group comprising a collimated source, a laser source, and an LED.

5. A drop detection arrangement comprising:

a light source for projecting a light beam for scattering light off of an ejected drop;

a light collector configured to collect the scattered light off the ejected drop;

a light detector coupled to the light collector and configured to process scattered light into an output signal; and a controller configured to receive the output signal from the light detector, the output signal indicative of the condition of the ejected drop;

wherein the light collector comprises a light pipe configured to collect some of the light scattered from ink drops passing through the light beam.

6. The drop detection arrangement of claim 5, wherein the cross-sectional shape of the light pipe is one of a group comprising circular, elliptical, rectangular, square, triangular, hexagonal, octagonal, and decagonal.

7. A drop detection arrangement comprising:

a light source for projecting a light beam for scattering light off of an ejected drop;

a light collector configured to collect the scattered light off the ejected drop;

a light detector coupled to the light collector and configured to process scattered light into an output signal: and a controller configured to receive the output signal from the light detector, the output signal indicative of the condition of the ejected drop;

wherein the light collector comprises a core configured to propagate the scattered light and a cladding adjacent the core.

8. The drop detection arrangement of claim 7, wherein the light collector comprises a grating adjacent the core for directing the scattered light to the light detector.

9. The drop detection arrangement of claim 7, wherein the light collector comprises one of a group comprising a mirror, an anti-reflective coating, a reflective coating, and a Lambertian layer for aiding in the directing of the scattered light to the light detector.

10. A drop detection arrangement comprising:

means for projecting a light beam;

means for controllably ejecting droplets such that they passes through the light beam thereby scattering light;

means for collecting the light scattered from each of the droplets in a single collection device; and means for producing an output signal based on the all of the collected scattered light, the output signal indicative of the ejected droplets;

wherein the means for collecting the scattered light comprises a light pipe.

11. The drop detection arrangement of claim 10 wherein means for projecting a light beam comprises a laser, wherein the means for controllably ejecting droplets comprises a controller and plurality of ink drop ejectors.

12. The drop detection arrangement of claim 11, wherein the controller is configured to control the plurality of ink drop ejectors and to correlate control of the plurality ink drop ejectors with the output signal such that the condition of each of the ejected drops can be correlated to a particular ink drop ejector.

13. The drop detection arrangement of claim 11, wherein the output signal comprises a series of peaks, each peak indicative of an ink drop passing through the light beam.

14. The drop detection arrangement of claim 11, wherein the light pipe comprises a core configured to propagate the scattered light and a cladding adjacent the core.

15. The drop detection arrangement of claim 14, wherein the light collector comprises a grating adjacent the core for directing the scattered light to the light detector.

16. A method of detecting drop ejections in a drop ejection system, the method comprising:

projecting a light beam;

controllably ejecting droplets such that they pass through the light beam thereby scattering light;

collecting the light scattered from each of the droplets in a single collection device; and producing an output signal based on the all of the collected scattered light, the output signal indicative of the ejected droplets;

wherein collecting the scattered light comprises using a light pipe.

17. The method of claim 16, wherein projecting a light beam further comprises using a laser, wherein controllably ejecting droplets comprises using a controller and plurality of ink drop ejectors.

18. The method of claim 17, wherein the controller is configured to control the plurality of ink drop ejectors and to correlate control of the plurality ink drop ejectors with the output signal such that the condition of each of the ejected drops can be correlated to a particular ink drop ejector.

19. The method of claim 17, wherein the light pipe comprises a core configured to propagate the scattered light and a cladding adjacent the core.

* * * * *